US005637357A

United States Patent [19]

Stachelhaus et al.

[11] Patent Number: 5,637,357

[45] Date of Patent: Jun. 10, 1997

[54] ROTARY ELECTROSTATIC DUSTING METHOD

[75] Inventors: Gustav A. Stachelhaus, Milan; Gary S. Gielincki, Southfield, both of Mich.

[73] Assignee: Philips Electronics North America Corporation, New York, N.Y.

[21] Appl. No.: 580,408

[22] Filed: Dec. 28, 1995

[51] Int. Cl.[6] ..... B05D 1/06; B05D 5/12; B05D 5/04

[52] U.S. Cl. ..... 427/476; 427/427; 427/68; 427/71; 427/157; 118/622; 118/627

[58] Field of Search ..... 427/476, 475, 427/427, 480, 484, 64, 68, 71, 157; 118/621, 622, 627, 626, 629

[56] References Cited

U.S. PATENT DOCUMENTS

| | | | |
|---|---|---|---|
| 3,393,662 | 7/1968 | Blackwell | 427/484 |
| 3,593,678 | 7/1971 | Miller | 118/630 |
| 4,114,564 | 9/1978 | Probst | 118/626 |
| 4,186,285 | 1/1980 | Ribnitz | 427/10 |
| 4,430,359 | 2/1984 | Meisner | 427/31 |
| 5,332,162 | 7/1994 | Peck et al. | 239/690 |

*Primary Examiner*—Shrive Beck
*Assistant Examiner*—Michael Barr
*Attorney, Agent, or Firm*—Walter M. Egbert

[57] ABSTRACT

A technique for uniformly depositing particles, especially phosphor particles, onto a display panel and an apparatus for carrying out this technique are set forth in this application. This technique relies on both electrostatically and pneumatically passing charged particles to the display panel so that a uniform coating takes place both on the flat surfaces and on the curved surfaces.

6 Claims, 1 Drawing Sheet

ROTARY ELECTROSTATIC DUSTING METHOD

FIELD OF INVENTION

Figure 1:
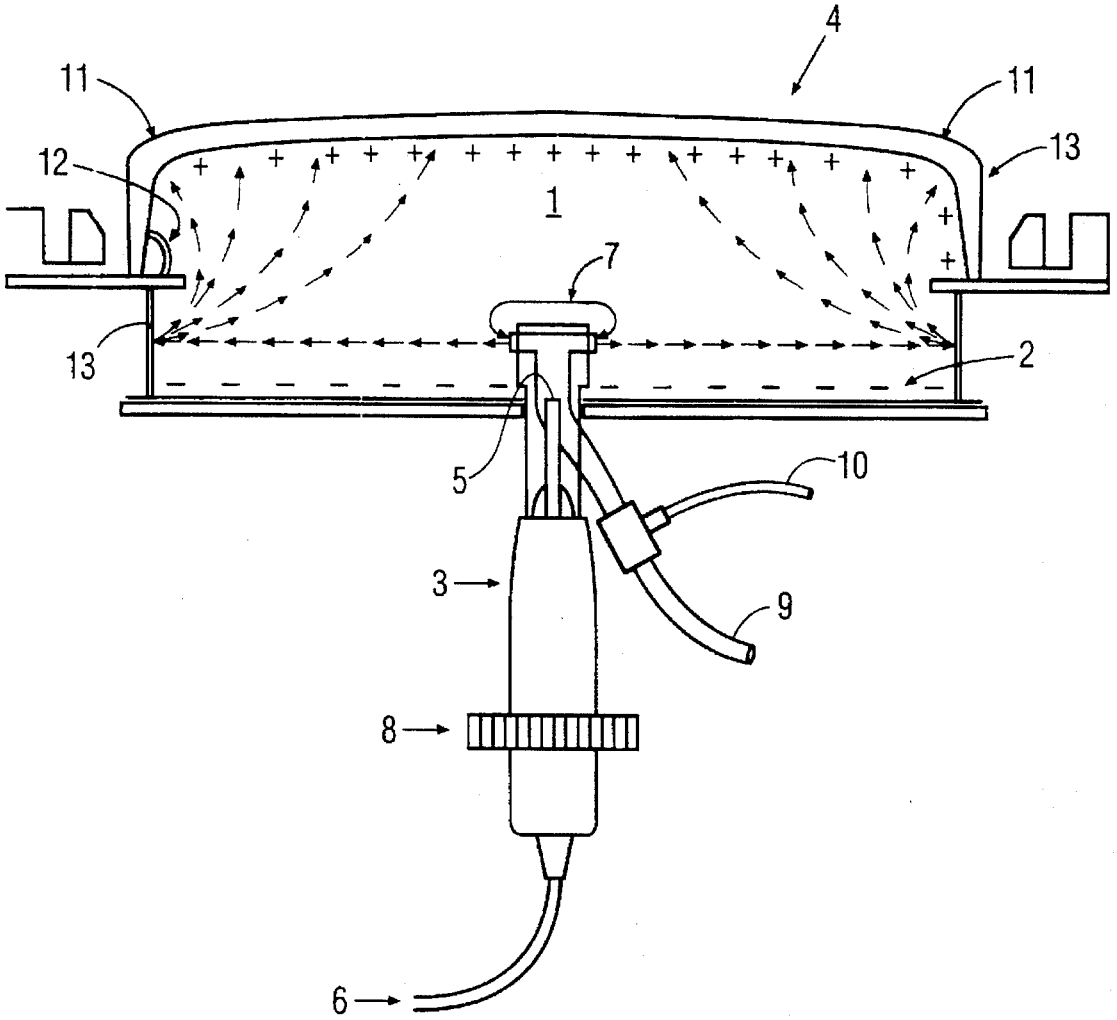

The present invention is directed to a novel technique and apparatus for uniformly dusting phosphors onto inner screen surfaces of cathode ray tubes, such as used in television. More particularly, the present invention provides a technique and apparatus for uniformly depositing the phosphors onto such inner display screens by rotating a discharge spray unit in both electrostatic and pneumatic fields so that an overall uniformity of phosphor deposits occur.

BACKGROUND OF THE INVENTION

A significant problem in display systems using cathode ray tubes, especially in color television systems, involve the provision of a uniform layer of phosphors on the inner face of the display screen. In particular, problems of uneven coverage at edges and comers of the display screen have traditionally occurred.

While various attempts at achieving uniform displays screens have been tried in the past, see European Patent Application No. 0 647 959, for example, these prior attempts have failed to achieve the results necessary in the field. The latter reference is directed at xerox-type devices, using a panel instead of paper and phosphors instead of ink. This type of device also uses a Tribo-charging system which is insufficient because significant drift occurs. Also, such a device requires a separate layer of conductive material and exposure through a mask before applying the phosphor.

SUMMARY OF THE INVENTION

The present invention is directed to a technique of uniformly depositing phosphors onto a display screen, as well as an apparatus for carrying out this technique in which both electrostatic and pneumatic fields are used.

The technique according to the present invention comprises the steps of fixing a display panel onto a spray chamber having a metal plate facing the display panel, grounding the display panel, inserting an electrostatic spray gun into the spray chamber with outlets pointing parallel to both the inner surface of the display panel and the metal plate, ionizing air passing from the spray gun to charge surrounding surfaces until the metal plate achieves a voltage sufficient to form a uniform repulsive field, feeding phosphor particles into the electrostatic spray gun to charge the phosphor particles, passing the charged phosphor particles into the spray chamber at a velocity sufficient to fill the spray chamber beneath the display panel, electrostatically depositing the charged particles onto the display panel while simultaneously pneumatically depositing the charged particles in the direction of the corner radii of the display panel, rotating the outlets of the electrostatic spray gun about the axis of the spray gun, stopping the feeding of phosphor particles from the spray gun as the rotation nears a final position while maintaining flow of air, turning off the flow of air when the final position is reached, and after a delay removing the now coated panel away from the spray chamber.

The technique of the present invention may be carried out by forming a negative voltage of −20 to −40 kV on the metal plate, while maintaining the display panel at ground potential. The charged phosphor particles may be passed into the spray chamber through spray nozzle openings of the spray gun at velocities upto about 170 feet per second (fps).

In a preferred embodiment of the present invention, the outlets of the nozzle openings of the spray gun are rotated 360° about its axis from a start position to a stop position, and then the rotation is reversed back to the start position. However, upon the use of a sliding electrical connection to the spray gun, for example, then continuous rotation may be carried out.

In the maintaining of the flow of air into the spray chamber after stopping the feeding of phosphorus particles from the spray gun, a cleaning of the system is achieved before beginning the deposition onto the inner surface of a new display panel in a continuous operation. In this respect, at least 300 coated panels per hour may be manufactured and achieved by using this technique of the present invention.

In a particular benefit of the present invention, the simultaneous electrostatic deposition of the charged particles onto the inner surface of the display panel while pneumatically depositing the charged particles in the direction of the corner radii of the display panel achieves a significant improvement over the prior art types of phosphor formation on display panels or windows because a much more uniform deposition of the charged phosphor particles has occurred by the present invention.

The present invention further is directed to an apparatus for accomplishing this deposition of phosphors onto the inner surface of a display window.

The apparatus according to the present invention comprises the structure of a spray chamber having an open side and an oppositely disposed metal plate, an electrostatic spray gun disposed through the metal plate directed toward the open face, a display window disposed to close the open side, energizing means for ionizing particles in the spray chamber by corona charging of surrounding surfaces of the spray chamber with the metal plate being at a voltage sufficient to form a uniform repulsive electric field to charged particles, means for passing charged phosphor particles in ionized air into the chamber parallel to the metal plate and the display window at a velocity sufficient to fill the chamber beneath the display window, means for rotating the means for passing charged phosphor particles about an axis from a first position to a second stop position, means for stopping the charged phosphor particles from entering the spray chamber when nearing the second stop position, and means for stopping air flow from the spray gun at the second stop position.

In a particular feature of the present apparatus, the display window is provided at ground potential, while a very high negative voltage on the metal plate forms structure for electrostatically depositing the charged phosphor particles onto the inner surface of the display window. Further in this structure, the air flow with the charged particles from the spray nozzles is in such a manner as to cause a pneumatic spray of the charged phosphor particles into the corner radii of the inner surface of the display window. In this manner, a significant uniform coating of the inner surface of the display window occurs according to the present invention.

In the present invention, the structure of the spray gun involves the passing of phosphor particles mixed in an air stream past a high voltage electrode of the spray gun to form electrical charge on the phosphor particles. Atomizing air mixes with the phosphor particle-air flow to further pass the charged phosphor particles into the spray chamber in a direction parallel to both the metal plate and the display window. The flow of the highly charged phosphor particles in air from the openings of the spray nozzles is parallel to the metal plate and the display window so as to strike the sides of the spray chamber and be pneumatically directed upwardly toward the radii at the comers of the display window. In this manner, the simultaneous electrostatic deposition and the pneumatic deposition of the charged phosphor particles onto the inner display window surface creates a very uniform deposition according to the present invention.

The energizing structure for ionizing the phosphor particles in the spray chamber by corona charging involves the use of the high voltage electrode in the electrostatic spray gun, which electrode is at about 80 kV. The phosphor particles pass out of the spray nozzle at a high velocity of about 170 fps in order to fill the space of the spray chamber with the charged phosphor particles in ionized air so as to electrostatically deposit on the display window.

In one embodiment of the present invention, the means for rotating the electrostatic spray gun first rotates the spray gun for at least about 360° about the axis of rotation from a first position, and then reverses the rotation back to the first position. However, according to the present invention, the spray gun may be continuously rotated about its axis of rotation beyond the about 360° position from the first position until a second stop position is reached where a uniform coating of all parts of the inner surface of the display window has occurred, including both the flat inner surfaces and the curved inner surfaces of the display window.

The charged phosphor particles are stopped from the spray nozzles when the rotation is about 30° to 90° from the stop position. This may occur in a time of about one second from the stop position and enables the air flow, flowing into the spray chamber, to virtually clear the atmosphere in the chamber of the charged phosphor particles so that very little subsequent cleaning of the spray chamber is necessary. In this manner a high number of panel members may be coated on inner surfaces in a given period of time, such as, for example, about 300 pieces per hour.

DESCRIPTION OF THE DRAWING FIGURE

The single drawing FIGURE in this application shows the structure of the presently claimed apparatus for carrying out the technique of the present invention. The drawing FIGURE is schematic and not to scale in order to show the technique of the operation of the apparatus.

DESCRIPTION OF THE INVENTION

The arrangement and operation of the present invention may be seen by reference to the single drawing FIGURE. In this device, a spray chamber 1 is generally shown having a rectangular or oblong shaped bottom of a metal plate 2 with side walls 13 surrounding the metal plate 2. The spray chamber 1 is closed by attaching the panel or window 4 to be interiorly coated onto the side walls 13.

Centrally located through the metal plate 2 is a spray gun arrangement 3, which may be Nordson Verga type spray gun. A high voltage (about 80 kV) electrode 5, activated by a voltage supply 6, extends in the spray gun 3 to a location just below the spray nozzle 7. The spray nozzle 7 has spray openings located around the circumference of the spray gun at its upper end. The phosphors to be coated onto the inner surface of the panel 4 pass into the spray gun 3 through the tube 9, together with a mixture of air both from the tube 9 and separately through the tube 10. This phosphor particle/air mixture passes by the high voltage electrode 5 to be ionized before passing into the spray chamber 1.

The ionized phosphor and air particles fill the spray chamber 1 and are both electrostatically passed to the panel 4 and pneumatically passed to the inner comers of the panel 4, as may be seen by the arrows in the drawing FIGURE. The metal plate 2 is at a very high negative voltage, ie. −20 to −40 kV, while the panel 4 is grounded, thus establishing a very high electrostatic field on the phosphor ions in the direction of the panel. The air stream out of the nozzles 7 is at a sufficiently high velocity, ie. 170 feet per second, to cause the phosphor particles initially coming out of the nozzle to strike the sidewalls 13 and be pneumatically deflected upwardly toward the comers of the panel 4. In this manner, the phosphor particles strike the inner corner faces of the panel 4 and coat them thoroughly. The high electric fields in the chamber cause the ionized phosphor particles to stick completely over the inner surface to complete the coating.

To further uniformly coat the inner surface of the panel 4, the spray gun or the spray nozzle is rotated by way of a drive gear 8. In this manner the ionized phosphor particles and ionized air molecules continually fill the spray chamber in a uniform cloud so that all surfaces of the inner surface of the panel 4 may be uniformly coated. The ionized particles are at a potential of about −50 kV to be attracted to the grounded potential of the panel 4.

The flow of the phosphor particles and air from the spray nozzles 7 is parallel to both the surface of the metal plate 2 and the panel 4. This parallel flow enables the phosphor particles to be pneumatically directed upwardly into the comers of the panel 4. Also, since the flow of particles is not directly at the panel, non-uniform powder delivery does not show up directly on the panel.

In operation of the present invention the panel 4 is initially coated with a standard photoresist to aid in the subsequent attachment of the phosphor particles. Such photoresist may be a water soluble polymer, such as polyvinylalcohol dissolved in water. This photosensitive coating becomes electrically conductive in the electrostatic field at ground potential, aiding in the attraction and sticking of the ionized phosphor particles to the panel.

Thereafter, power is turned on to the spray gun to a high voltage, ie. 80 kV, and this high voltage ionizes the air around the electrode 5. The ionized air begins to charge all of the nearby surfaces, including the metal plate 2 at the bottom of the spray chamber 1. The high negative field, ie. about −20 to −40 kV, on the metal plate 2 forms a uniform repulsive electric field to help direct the ionized phosphor particles to the panel 4. This operation is done in a clean environment for the protection of dirt, lint or other particles from being ionized in the spray chamber.

Next, the spray gun 3, or the spray nozzle 7, begins to rotate and air at 7 to 12 cubic feet per minute and phosphor particles at 1 to 3 grams per second are fed through the gun past the high voltage electrode 5. The air and phosphor particles are then highly charged and ionized and shot out of the spray nozzles 7 at a high velocity, ie. 170 feet per minute. The charged particles and air stream strike the side walls and bottom of the spray chamber, slow down, and spread out, moving to fill the chamber and the area under the panel 4 in an ionized cloud. The pneumatic air flow pattern cause the particles to strike the side walls and be deflected upwardly into the internal corner radii of the panel at the areas 11, while the electrostatic fields between the metal plate 2 and the panel 4 move the phosphor particles to the grounded inner surface having the wetted photoresist to be stuck thereon. During this electrostatic deposition, the ionized phosphor particles are both being repelled by the metal plate 2 and attracted to the grounded panel 4.

As this occurs, the spray gun, or the spray nozzle, is rotated in one direction. This rotation is for at least 360° and beyond to form a continuous cloud of charged particles being attracted or pneumatically pushed to the panel 4. In one process, the rotation is continuous and the particles are sprayed into the chamber until about 30° to about 90° from a stop position, depending on the type of phosphor particles and photoresist being used. At that point the phosphor particles are stopped from being fed into the spray gun and the air flow is continued to clean residual particles out of the feed hose 9 and to circulate the remaining particles in the spray chamber until they are attracted to the panel 4.

When the spray gun or spray nozzles reach a stop position, the air flow is turned off. Subsequently, the ground contacts 12 are removed from the panel 4. Then the panel is removed from the spray chamber and spray gun. A next panel is then attached, and the process starts over again. Some 300 panel per hour can be coated this way, far exceeding conventional processes.

Alternatively, the rotation of the spray nozzles, during the spraying of the charged particles, may be for only about 360° and then the rotation stopped. Thereafter, the rotation is reversed back to the start position under the same stop conditions as described above for stopping the feeding of phosphor particles and air flow.

What we claim:

1. A method for uniformly depositing particles onto a display surface comprising the sequence of steps of:

(a) fixing a display panel having corner radii onto a spray chamber having a metal plate facing the display panel, (b) grounding the display panel, (c) inserting an electrostatic display gun into the spray chamber with outlet nozzles pointing parallel to both an inner surface of the display panel and the metal plate, (d) ionizing air passing from the spray gun to charge surrounding surfaces until the metal plate achieves a voltage sufficient to form a uniform repulsive field, (e) feeding phosphor particles into the electrostatic spray gun to charge the phosphor particles, (f) passing the charged phosphor particles into the spray chamber at a velocity sufficient to coat the corner radii of the display panel and to fill the spray chamber positioned beneath the display panel, (g) electrostatically depositing the charged particles onto the display panel while simultaneously pneumatically directing the charged particles in the direction of the corner radii of the display panel, (h) rotating the outlet nozzles of the electrostatic spray gun about the axis of the spray gun, (i) stopping the feeding of phosphor particles from the spray gun as the rotation nears a final position while maintaining flow of air, (j) turning off the flow of air when the final position is reached, and (k) after a delay during which the grounding is removed, removing the now uniformly coated panel away from the spray chamber.

2. A method according to claim 1, wherein said charged particles are passed into said spray chamber at velocities of about 170 feet per second.

3. A method according to claim 1, wherein said outlets of said nozzles are continuously rotated at least 360° and beyond to a stop position.

4. A method according to claim 3, wherein said charged flow of phosphor particles is stopped when said nozzles are positioned at about 30° to 90° from said stopped position.

5. A method according to claim 1, wherein said outlets of said nozzles are rotated at least 360° in one direction, stopped and reversed in rotation back to the start position.

6. A method according to claim 5, wherein said charged flow of phosphor particles is stopped when said nozzles are positioned at about 30° to 90° from said stopped position.

* * * * *